US005388962A

United States Patent [19]

Wygle et al.

[11] Patent Number: 5,388,962

[45] Date of Patent: Feb. 14, 1995

[54] TURBINE ROTOR DISK POST COOLING SYSTEM

[75] Inventors: Thomas G. Wygle, Loveland; David G. W. Fargher, Fairfield; Arthur J. Piekarski, Middletown, all of Ohio

[73] Assignee: General Electric Company, Cincinnati, Ohio

[21] Appl. No.: 136,143

[22] Filed: Oct. 15, 1993

[51] Int. Cl.[6] ..... F01D 5/08

[52] U.S. Cl. ..... 416/95; 416/220 R

[58] Field of Search ..... 416/95, 96 R, 190, 193 A, 416/219 R, 220 R, 500

[56] References Cited

U.S. PATENT DOCUMENTS

| | | | |
|---|---|---|---|
| 2,873,947 | 2/1959 | Perry | 416/220 R |
| 3,112,915 | 12/1963 | Morris | 416/220 R |
| 3,318,573 | 5/1967 | Matsuki et al. | 416/95 |
| 3,635,586 | 1/1972 | Kent et al. | 416/95 X |
| 3,709,631 | 1/1973 | Karstensen et al. | 416/95 |
| 3,751,183 | 8/1973 | Nichols et al. | 416/220 R |
| 3,768,924 | 10/1973 | Corsmeier et al. | 416/95 |
| 3,834,831 | 9/1974 | Mitchell | 416/95 |
| 3,887,298 | 6/1975 | Hess et al. | 416/220 R |
| 4,111,603 | 9/1978 | Stahl | 416/95 |
| 4,457,668 | 7/1984 | Hallinger | 416/95 |
| 4,659,285 | 4/1987 | Kalogeros et al. | 416/95 |
| 5,201,849 | 4/1993 | Chambers et al. | 416/95 |
| 5,281,097 | 1/1994 | Wilson et al. | 416/95 |

*Primary Examiner*—Edward K. Look
*Assistant Examiner*—James A. Larson
*Attorney, Agent, or Firm*—Jerome C. Squillaro; Bernard E. Shay

[57] ABSTRACT

The present invention discloses a system for cooling turbine rotor disk posts in a gas turbine engine with a preferred embodiment illustrating an application for a high pressure turbine stage 1 rotor disk. The disk includes a plurality of circumferentially alternating posts and slots disposed about the periphery of the disk with each slot receiving a dovetail of a radially extending blade. The cooling system comprises a plurality of seal bodies with each seal body including a relatively low volume thermal isolation chamber positioned over the top of a corresponding disk post; a plurality of axially extending blade cooling plenums supplied with cooling air with one of the plenums positioned radially inward of each of the blades; a plurality of shallow, radially extending slots formed in a relatively low stressed axially facing surface of each of the blade dovetails for diverting cooling air from the blade cooling plenums to the thermal isolation chambers. Cooling air flows from the blade cooling plenums through the slots into a radially extending plenum which supplies at least one hole in each seal body. The holes are in flow communication with the thermal isolation chambers and are oriented to cause the cooling air to impinge directly on the outer surface of each of the disk posts.

10 Claims, 5 Drawing Sheets

TURBINE ROTOR DISK POST COOLING SYSTEM

BACKGROUND OF THE INVENTION

1. Field of the Invention

The present invention relates to gas turbine engines, and more particularly to a system for cooling turbine rotor disk posts of gas turbine engines.

2. Related Art

Conventional high bypass ratio turbofan engines typically include a fan, booster, high pressure compressor, combustor, high pressure turbine and low pressure turbine in axial flow relationship. A portion of the air entering the engine passes through the fan, booster and high pressure compressor, being pressurized in succession by each component. The compressed air exiting the high pressure compressor, commonly referred to as the primary or core gas stream, then enters the combustor where the pressurized air is mixed with fuel and burned to provide a high energy gas stream. However, prior to entering the combustor a portion of the primary or core flow is diverted to provide a source of cooling air for various high temperature components, such as those found in the high pressure turbine. After exiting the combustor, the high energy gas stream then expands through the high pressure turbine where energy is extracted to operate the high pressure compressor which is fixedly connected to the high pressure turbine. The primary gas stream then enters the low pressure turbine where it is further expanded, with energy extracted to operate the fan and booster which are fixedly connected to the low pressure turbine. The remainder of the air flow which enters the engine, other than the primary gas stream continuing through the turbines and the cooling air flow, passes through the fan and exits the engine through a system comprising annular ducts and a discharge nozzle, thereby creating a large portion of the engine thrust.

The highest temperatures in the engine are found in the combustor and turbines. For instance, it is not uncommon for the temperature of the primary gas stream to exceed 2400° F. at the entrance to the first stage blade of the high pressure turbine. The demand for larger and more efficient gas turbine engines creates a requirement for increased turbine operating temperatures, with the metallurgical limitations of critical components such as rotor blades and disks in opposition to this requirement. For example, nickel based alloys are commonly used in the manufacture of turbine rotor disks and with such alloys a typical maximum metal temperature may be approximately 1100° F., which is considerably less than the maximum primary gas path temperature. Consequently, there is a continuing need for novel approaches to provide thermal protection for components such as turbine rotor disks.

A turbine rotor disk is an annular component which rotates about the longitudinal axis of the engine and which supports a plurality of blades that extend radially into the primary gas stream. The disk includes a plurality of circumferentially alternating dovetail slots and posts, with each post formed by adjacent slots, disposed about the periphery of the disk. Each disk dovetail slot is adapted to receive a corresponding dovetail portion, also referred to as a "fir tree" portion, of a blade, with the blades axially loaded into the disk. In addition to the dovetail portion, each blade includes a shank portion which extends radially outward, or away from the engine axis of rotation, from the dovetail portion, and a plate-like platform which radially separates the shank portion from an airfoil portion which extends radially outward from the platform. The outer surface of the blade platforms form a portion of the radially inner boundary of the primary gas stream flowpath, with the platform portions of adjacent stationary nozzle segments forming the remainder of the boundary. For instance, in a multi-stage turbine the stage 1 blades would be positioned between a row of stage 1 nozzles upstream of the blades, which provide the required direction of flow into the blades, and a row of stage 2 nozzles downstream of the blades. Due to the exposure of the blade airfoil to the hot gas stream and the metallurgical limitations of the blade material, it is known in the art to include interior cooling passages in the blade airfoil, with these passages typically supplied through an inner surface of the blade dovetail with the previously discussed compressor discharge air. This cooling air may discharge through a variety of film holes, tip cap holes and trailing edge holes in the blade airfoil, as known in the art.

A structure commonly known as a seal body is typically positioned over the top of each disk post in a cavity bounded by the top of the post, the shank portions of adjacent blades and the underside of the platforms of adjacent blades. The seal body includes a forward plate, which, together with windage baffles typically associated with the axially forward nozzles and the forward portion of the blade platform, or forward angel wing of the blade, forms a cavity on the forward side of the disk. Although this forward cavity is typically purged with the aforementioned compressor discharge cooling air, the cavity air temperature is substantially hotter than the cooling air entering the dovetail portion of the blades due to leakage of hot gases from the primary gas stream into the forward cavity. On an average basis the forward cavity temperature may be 100°–150° F. hotter than the blade cooling air, whereas it may be several hundred degrees higher locally due to rotor/stator non-concentricities or manufacturing tolerances causing increased ingestion of flowpath gases locally. Based on the foregoing, it can be seen that the forward cover plates of the seal bodies discourage the forward cavity purge air, as well as any flowpath gases which are ingested into the forward cavity, from flowing axially between adjacent blade shanks over the tops of the disk posts. The disk post temperature is determined by a heat balance which includes: conduction cooling due to contact with the blade along the dovetail interface; forced convection cooling due to any leakage of blade cooling air which flows through spaces between the disk and blade dovetail serrations, rather than flowing through the blade passages; and convection heating due to hot air surrounding the top of the disk post, with the air being a mixture of the forward cavity air and leakage air from the primary gas stream which is ingested between the platforms of adjacent blades. This air mixture surrounding the top of the disk post is substantially hotter than the blade cooling air. Consequently, thermal isolation of the top of the disk post, from this hot air mixture, is an important part of the overall system for ensuring that the temperature of the disk post does not exceed allowable limits.

Various systems have been employed to provide the necessary isolation of the top of the disk post. One prior disk post isolation system includes shields located at the radially inward side of the blade platforms such that each shield spans the gap between platforms of adjacent blades to discourage ingestion of flowpath gases, and further includes cooling holes through the shank portions of the blades which communicate with the blade interior cooling air passages in order to purge the cavities between the shanks of adjacent blades over each disk post. This system has the disadvantage of placing holes in a highly stressed region of the blade with the stress concentrations associated with the holes creating the potential for cracking and premature failure of the blades. This design has a further disadvantage due to the requirement of purging the relatively large cavities formed between shanks of adjacent blades and bounded at an outer end by the blade platforms and at an inner end by the top of the disk post, which results in the use of a relatively high amount of compressor discharge cooling air and the associated engine performance penalty.

A second prior disk post isolation system, which is illustrated in FIGS. 1 and 2 of this application and subsequently discussed in detail, includes a plurality of seal bodies 31. The seal body 31 illustrated in FIGS. 1 and 2 of this application is substantially the same, with the exception of additional structural features which are present for purposes which are not related to the thermal isolation of disk posts, as the seal body disclosed in U.S. Pat. No. 5,201,849, which is assigned to the assignee of the present invention, and which is herein expressly incorporated by reference. Each seal body 31 has a small diffuser hole 142 extending through a forward cover plate 132 of seal body 31. The entrance of the diffuser hole 142 is in flow communication with the forward cavity 134 and the hole exit is in flow communication with a thermal isolation chamber 144 which is positioned over the top 33 of the disk post 20. Chamber 144 has a relatively small volume as compared to the volume of the cavity bounded by the shanks 26 and platforms 28 of adjacent blades 22 and the radially outer surface 33 of one of the disk posts 20. The diffuser hole 142 causes forward cavity air to slowly drift over the top or radially outer surface 33 of the disk post 20 in order to form an insulative layer of air over the disk post 20. With this system care has to be taken to ensure that the forward cavity air does not pass across the top 33 of the disk post 20 at too high a velocity. Unacceptably high velocities can cause the forced convection from the relatively hot forward cavity air passing across the top 33 of the disk post 20 to dominate the disk post heat balance which can actually result in the disk post temperature rising. Consequently, the system is sensitive to manufacturing tolerances regarding the geometry of diffuser hole 142. One way to obviate the disadvantage associated with the diffuser hole 142 is to lower the temperature of the forward cavity air. However, this would be costly in terms of reduced engine performance due to the relatively high amount of cooling air required to completely purge the forward cavity 134 to effect a reduction in temperature of the forward cavity air. A high amount of cooling air would be required due to the relatively large gaps between the blade angel wing 138 and the associated stator windage baffle structure 128 and stage 1 nozzle inner platform 122 which is required to prevent rubs during engine transient conditions, with the gaps creating a path for ingested gases into the forward cavity 134.

In view of the foregoing, prior to this invention a need existed for a cooling system in a rotor assembly of a gas turbine engine to cool the top of rotor disk posts in a cost effective manner without compromising the structural integrity of the rotor blades and without undue sensitivity regarding the geometry of cooling holes employed.

SUMMARY OF THE INVENTION

The present invention is directed to a system for cooling disk posts in a rotor assembly of a gas turbine engine, the rotor assembly including a plurality of radially extending blades mounted on a turbine rotor disk, wherein the disk includes a plurality of circumferentially alternating posts and slots disposed about a periphery of the disk. Each slot receives a dovetail portion of one of the radially extending blades. Each blade further includes a shank portion extending radially outward from the dovetail portion and a platform portion atop the shank portion.

According to a preferred embodiment of the present invention the disk post cooling system comprises: a plurality of seal bodies, wherein each of the seal bodies includes a thermal isolation chamber positioned over the radially outer surface of a corresponding one of the disk posts; means for supplying cooling air to a plurality of axially extending cooling plenums positioned radially inward of the blades, wherein the plenums extend through the disk; and means for diverting cooling air from the axially extending blade cooling plenums to each of the thermal isolation chambers.

Another preferred embodiment in accordance with the present invention includes the following additional structural features and functions. Each seal body is positioned in a cavity bounded by the radially outer surface of one of the disk posts, the shank portions of adjacent blades and the platform portions of the adjacent blades. Each of the seal bodies includes an axially forward cover plate, an axially aft cover plate and a connecting channel member integrally connected to each of the forward and aft plates, wherein the connecting channel member includes a pair of radially inward and opposed legs which form the thermal isolation chamber. Each of the axially extending plenums is defined by a radially inner surface of the dovetail portion of one of the blades, circumferentially opposing sides of adjacent disk posts and a contoured disk slot bottom interconnecting the opposing sides. The cooling system further comprises an annular blade retainer having a radially inner end fixedly attached to the disk using conventional attachment means such as shoulder bolts. The blade retainer includes an inner sealing means in sealing engagement with an axially forward surface of each of the blade dovetail portions and an axially forward surface of each of the disk posts, and an outer sealing means positioned radially outward of the inner sealing means and in sealing engagement with an axially forward surface of each of the axially forward cover plates of the seal bodies. Each of the inner and outer sealing means comprises an annular groove formed in an axially aft surface of the blade retainer and an annular seal wire disposed in each of the grooves. The means for diverting comprises a radially extending slot formed in the axially forward surface of each of the blade dovetail portions, which is a relatively low stressed area of the blade, and passage means formed in each of the seal bodies for directing cooling air into the thermal isolation chambers positioned over the top of the disk posts. The slots are relatively shallow and do not extend into the hollow interior of the blades. Each slot has an entrance adjacent to and in flow communication with one of the axially extending plenums which are positioned radially inward of the blades. Furthermore each slot entrance is radially inward of the inner sealing means and each slot exit is radially outward of the inner sealing means, which allows blade cooling air to be routed past the inner sealing means of the blade retainer. Each slot exit is adjacent with and in open flow communication with an annular radially extending cooling air plenum formed at inner and outer ends by the inner and outer sealing means, respectively, at a forward end by the axially aft surface of the blade retainer and at an axially aft end by the axially forward surfaces of each of the blade dovetail portions, disk posts and axially forward cover plates of the seal bodies. The passage means comprises at least one hole extending through the axially forward cover plate of each of the seal bodies with each hole having an entrance adjacent the annular radially extending plenum radially inward of the outer sealing means and an exit adjacent one of the thermal isolation chambers, wherein the holes are preferably oriented relative to the engine axis of rotation so as to cause the cooling air to impinge directly on the radially outer surface of each disk post. The seal bodies are positioned such that the axially forward cover plates of the seal bodies are in circumferentially abutting relationship with one another with the abutting sides of each forward cover plate extending radially outward of the outer sealing means in order to achieve the required sealing at the outer end of the annular radially extending plenum.

BRIEF DESCRIPTION OF THE DRAWINGS

The structural features and functions of the present invention will become more apparent from the following detailed description of the preferred embodiments when taken in conjunction with the accompanying drawings in which.

DETAILED DESCRIPTION

Figure 1:
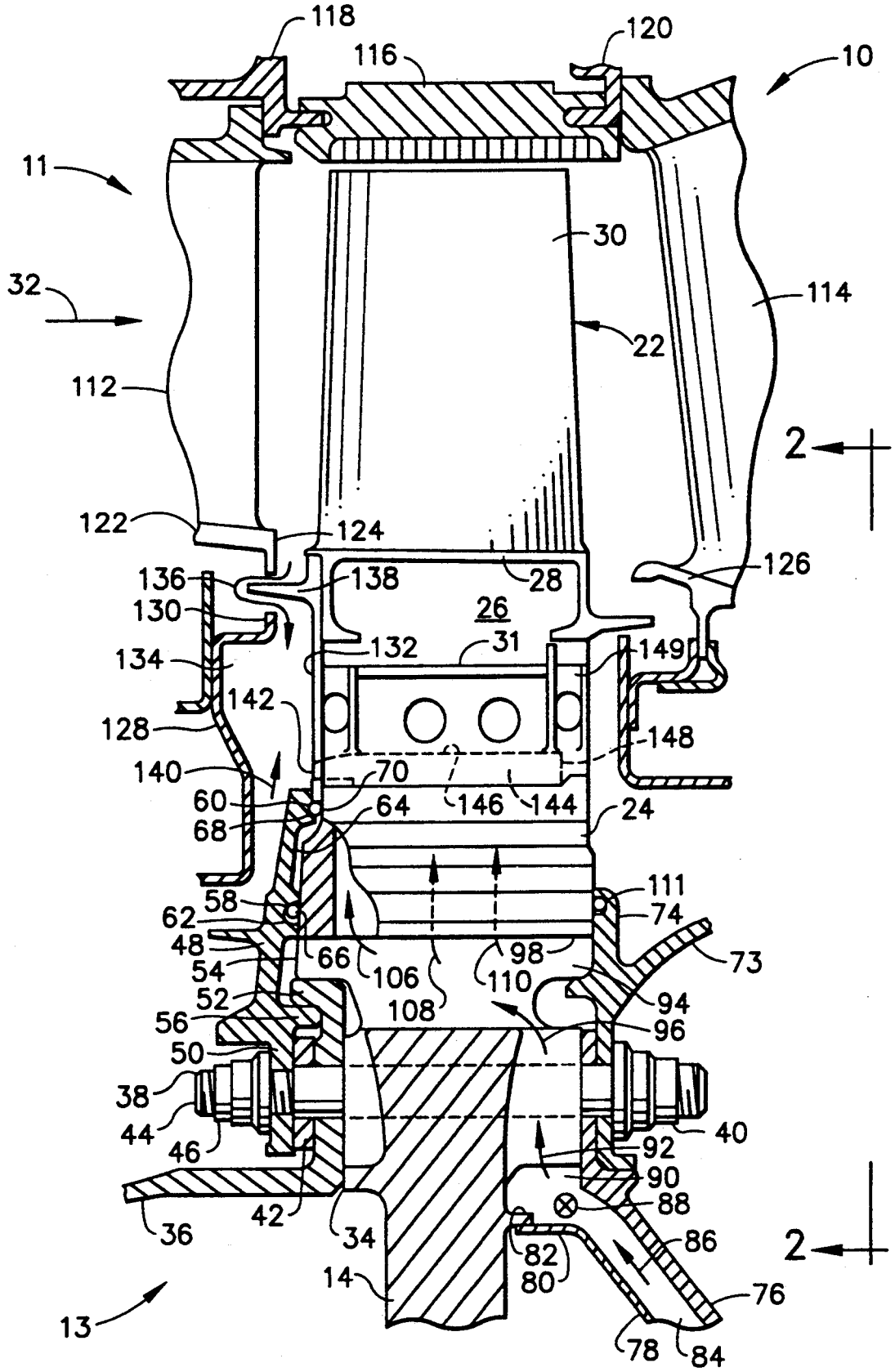
FIG. 1 (PRIOR ART)
FIG. 1 is a fragmentary cross-section, taken along an engine longitudinal axis, illustrating a prior art rotor assembly Which can be modified to accept the disk post cooling system of the present invention. The cross-section is not taken along a continuous radial line. Instead the section line is radial from a disk inner hub through a disk slot bottom, with the section line then offset circumferentially a first time to illustrate a side view of a blade dovetail section positioned radially outward of the disk slot bottom and offset circumferentially a second time to illustrate a side view of a seal body positioned atop a disk post (not shown) adjacent to the blade dovetail and further illustrating side views of the shank, platform and airfoil portions of the blade. A forward portion of the blade dovetail portion has been cut away to illustrate an internal blade cooling passage.
Figure 2:
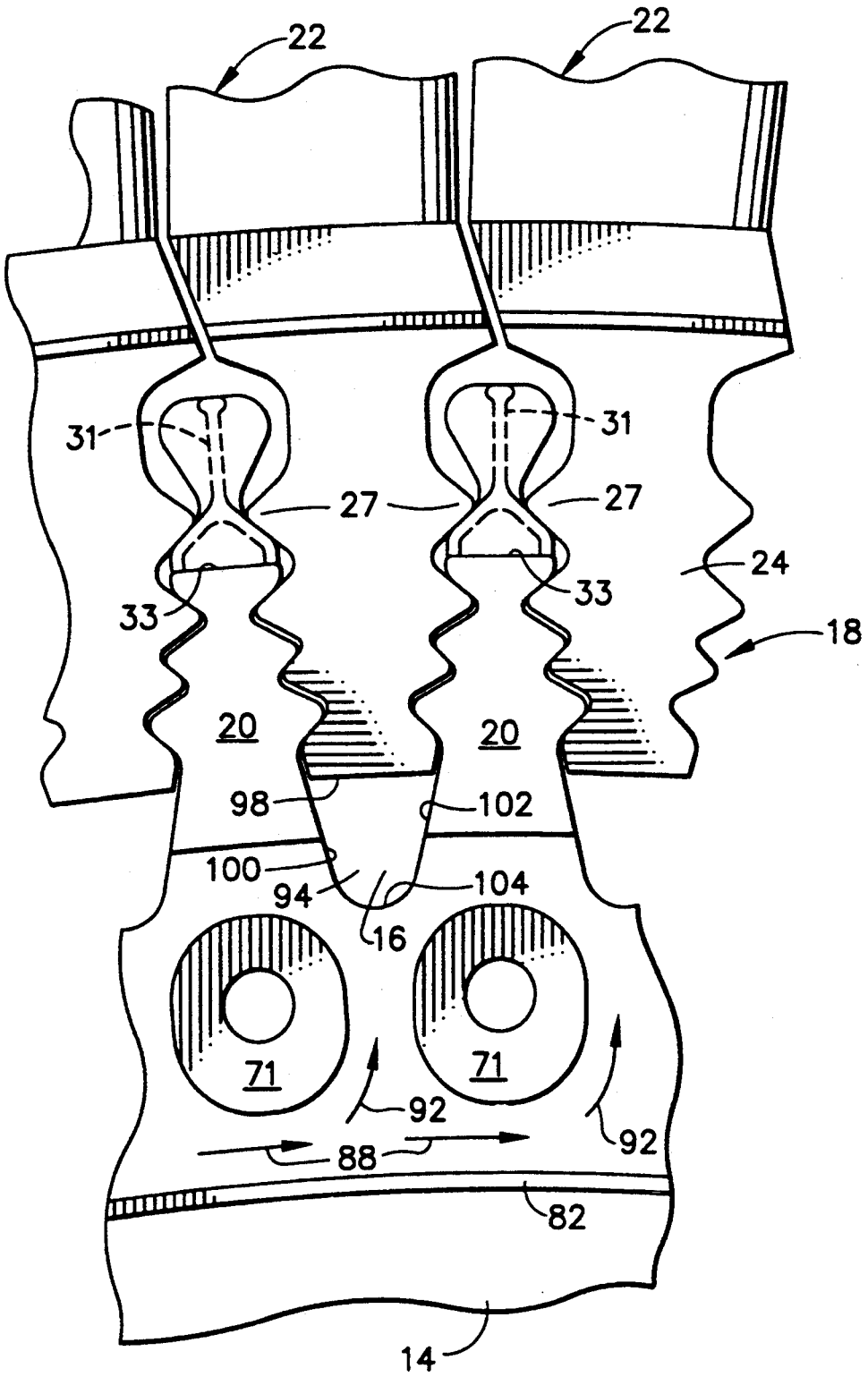
FIG. 2 (PRIOR ART)
FIG. 2 is an axial view taken along line 2—2 in FIG. 1, with the thermal shield, spacer impeller, spacer impeller cover and associated fastening means omitted to illustrate the disk aft embossments.

Referring now to the drawings, wherein like reference numerals have been used for similar elements throughout, FIG. 1 illustrates a fragmentary axial cross-section of an exemplary gas turbine engine 10. The engine 10 includes, in serial axial flow communication about an axially extending longitudinal centerline axis 12, conventional components including a fan, booster, high pressure compressure, combustor (all not shown), high pressure turbine 11, and low pressure turbine (also not shown). High pressure turbine 11 is drivingly connected to the high pressure compressure with a first rotor shaft 36 and the low pressure turbine is drivingly connected to both the booster and the fan with a second rotor shaft (not shown). High pressure turbine 11 includes prior art stage 1 rotor assembly 13 which is rotatable about axis 12. Rotor assembly 13 includes stage 1 turbine rotor disk 14 which, as best seen in FIG. 2, has a plurality of slots 16 disposed about the periphery 18 of disk 14, with circumferentially adjacent ones of slots 16 forming a plurality of disk posts 20. A plurality of radially extending blades 22, one of which is shown in FIG. 1, are mounted on disk 14. Each disk slot 16 receives a dovetail portion 24 of one of the blades 22. In the illustrative embodiment, disk slots 16 and blade dovetail portions 24 are formed to have a characteristic fir tree shape although other forms of blade to disk interlocking, which are known in the art, may be utilized. Blades 22 are axially loaded into axially extending disk slots 16. Each blade 22 also includes a shank portion 26, which extends radially outward of dovetail portion 24, a platform portion 28 atop shank portion 26, and an airfoil portion 30 which extends radially outward from platform portion 28 into primary gas path 32. Rotor assembly 13 further includes a plurality of seal bodies 31, for a subsequently discussed purpose, with one of the plurality of seal bodies 31 positioned over a radially outer surface 33 of each of the disk posts 20, as best seen in FIG. 2.

Disk 14 is fixedly connected at an axially forward surface 34, which may comprise a plurality of forward embossments, to rotor shaft 36 with conventional fastener means such as a plurality of shoulder bolts 38 and nuts 40. Bolt 38 includes bolt head 42, which clamps rotor shaft 36 to disk 14, and stud 44 which extends axially forward of bolt head 42. Stud 44 in combination with nut 46 allows annular blade retainer 48 to be fixedly connected, at radially inner end 50, to the assembly comprising rotor shaft 36 and disk 14 after blades 22 have been loaded into disk 14 and without losing the clamp load between rotor shaft 36 and disk 14. Diametrical rabbet fits, which are known in the art, are formed between a radially outward and axially extending annular flange 52 of rotor shaft 36 and annular forward shoulder 54 of disk 14 and between flange 52 and axially extending annular flange 56 of blade retainer 48, with the rabbet fits providing the desired concentricity among the affected components. Annular blade retainer 48 prevents blades 22 from moving in an axially forward direction in disk slots 16. Blade retainer 48 includes inner sealing means 58 and outer sealing means 60 which are in sealing engagement, for purposes to be described subsequently, with the blade dovetail portions 24 and disk posts 20. Inner sealing means 58 includes annular groove 62 formed in axially aft surface 64 of blade retainer 48 and an annular seal wire 66 disposed in groove 62. Similarly, outer seal means 60 includes annular groove 68 formed in surface 64 and annular seal wire 70 disposed in groove 68.

The axially aft side of disk 14 includes a plurality of circumferentially spaced aft embossments 71 as best seen in FIG. 2. Annular thermal shield 73 extends between the aft side of stage 1 disk 14 and the forward side Of a stage 2 disk (not shown) and is in sealing engagement with a stationary sealing element of a stage 2 interstage seal (also not shown). Forward flange 74 of annular thermal shield 73 and an annular spacer impeller 76 are fixedly attached to aft embossments 71 of disk 14 using shoulder bolts 38 and nuts 40. Spacer impeller 76 is fixedly attached at an inner end (not shown) to the stage 2 disk. Annular spacer impeller cover 78 includes forward flange 80 which is in sealing engagement with aft lip 82 which is integrally connected to and extends axially aft of the aft surface of disk 14. Spacer impeller cover 78 is fixedly attached at an inner end (not shown) to the stage 2 disk at the same locations as spacer impeller 76. When taken together, spacer impeller 76 and cover 78 form an annular cooling air channel 84. A portion of the air discharging from the high pressure compressor is diverted 16 provide a source of cooling air to high temperature components such as blades 22. This cooling air flows axially forward through a combination of stationary and rotating components of the gas turbine engine 10 and eventually flows under the inner bore (not shown) of disk 14 and enters a cavity (not shown) between disk 14 and the stage 2 disk. A portion of the air entering this cavity then enters channel 84. During operation of engine 10 centrifugal force pumps the cooling air in channel 84 radially outward as depicted by arrow 86. The cooling air then flows circumferentially, as indicated by arrow tail 88 in FIG. 1 and arrow 88 in FIG. 2 (where thermal shield 73, spacer impeller 76, spacer impeller cover 78, bolt 38 and nut 40 have been omitted to illustrate embossments 71 and adjacent cooling air paths 92) through annular plenum 90 which is formed by spacer impeller 76, cover 78 and disk 14. The cooling air then flows radially outward between circumferentially adjacent aft bosses 71 as depicted by arrows 92 and enters a plurality of axially extending blade cooling plenums 94 as depicted by arrow 96 for one of the plenums 94. Each of the plenums 94 extend axially through disk 14 and are positioned under a radially inner end 98 of a respective blade 22, with each plenum 94 defined by inner end 98, opposing sides 100 and 102 of adjacent disk posts 20 which are circumferentially adjacent the respective one of blades 22, and a contoured disk slot bottom 104 which interconnects opposing sides 100 and 102. The cooling air then enters a plurality of internal blade cooling air passages as depicted by arrows 106, 108, and 110, with each passage being in open flow communication with a corresponding one of the axial plenums 94. A portion of the passage corresponding to flow arrow 106 is illustrated by a partial cutaway view of dovetail portion 24 of blade 22. Inner sealing means 58 of blade retainer 48 prevents the cooling air from escaping from the forward end of plenums 94, thereby inhibiting the cooling air from bypassing the internal blade cooling passages. Similarly, sealing means 111, which is formed in the radially outer end of forward flange 74 of thermal shield 73, inhibits the cooling air from escaping the aft end of plenums 94. The cooling air which enters the interior blade cooling air passages exits into the primary gas flowpath 32 through a variety of film holes, blade tip cap holes and trailing edge holes (not shown) in a manner known in the art. The temperature of the blade cooling air may typically be approximately 1000° F. during a maximum operating condition of engine 10.

The stationary turbine structure surrounding stage 1 rotor disk 14 includes a plurality of axially forward stage 1 nozzle segments 112 and a plurality of axially aft stage 2 nozzle segments 114, with a portion of one of each of the segments 112 and 114 depicted in FIG. 1. A plurality of circumferentially segmented shrouds 116 surround the tips of blades 22 and are conventionally supported with forward shroud support 118 and c-clip 120 (wherein the support structure mating with clip 120 is not shown). Each of the stage 1 nozzle segments 112 includes an inner platform 122 and a radially extending aft lip 124. Each of the stage 2 nozzle segments 114 include an inner platform 126, which when taken together with platforms 122 and blade platforms 28 form a portion of the inner annular boundary for primary gas path 32. Windage baffle cover 128 is attached to the structure which supports stage 1 nozzle segments 112, in a manner known in the art. Baffle cover 128 can comprise a plurality of circumferentially extending segments and includes outer baffle lip 130. Baffle cover 128, annular blade retainer 48 and a forward cover plate 132 of each of the seal bodies 31 together form forward cavity 134 which is positioned forward of disk 14. During operation of engine 10 hot gases can be ingested into forward cavity 134, with the leakage gases flowing along the path depicted by arrow 136. Leakage gases following path 136 flow through an annular gap formed between the stage 1 nozzle platform aft lip 124 and a forward angel wing 138 of seal body forward cover plate 132 and through an annular gap formed by angel wing 138 and outer baffle lip 130. It should be understood that forward angel wing 138 can be included as an integral part of blade platform 28. The aforementioned gaps may be relatively large in order to prevent rubs between angel wing 138 and platform lip 124 and baffle lip 130 during transient excursions of engine 10. In order to discourage the ingestion of leakage air along path 136, forward cavity 134 is purged with cooling air as depicted by arrow 140. Purge air 140 is typically supplied by the previously discussed portion of high compressor discharge air which is diverted for cooling purposes. Notwithstanding the use of purge air 140, the temperature of the forward cavity air can typically be 100°–150° F. hotter on an average basis than the air entering each blade 22 along paths 106, 108, and 110, due to the ingestion of leakage gases along path 136. Rotor to stator non-concentricities, as well as manufacturing tolerances can cause increased ingestion of gases along path 136 in circumferentially localized areas, which in turn can cause the temperature of the forward cavity air to be several hundred degrees higher than the blade cooling air.

Each of the seal bodies 31 of FIG. 1 includes a small diffuser hole 142 which extends through the forward cover plate 132 of seal body 31 and which has an entrance in flow communication with forward cavity 134 and an exit in flow communication with a thermal isolation chamber 144 formed in seal body 31. The cross-section of chamber 144 can be approximated by a generally rectangular inner portion and a generally triangular outer portion above the inner portion, with the apex of the generally triangular outer portion indicated by dashed line 146. Chamber 144 is positioned over the radially outer surface 33 of a corresponding one of the disk posts 20 and is closed at an aft end 148 by an aft portion 149 of seal body 31. The exterior of seal body 31 acts to shield the radially outer surface 33 of disk post 20 from hot flowpath gases which-can be ingested into the cavity above disk post 20 due to gaps formed between platforms 28 of adjacent blades 22. The disk post 20 is further protected thermally by forward cavity air, which is at a higher pressure than that of primary gas flowpath 32, which enters chamber 144 through diffuser hole 142. The diffusing action of diffuser hole 142 causes a relatively low velocity and insulating layer of air to drift across the radially outer surface 33 of disk post 20. Due to the relatively low velocity, the associated convection heat transfer is also low. During operation of engine 10 centrifugal force causes seal body 31 to be forced radially outward against damper lobes 27 which are integrally connected to shank portions 26 of adjacent blades 22 and seal body 31 is sized such that a radial gap exists between an inner end of seal body 31 and outer surface 33 of disk post 20, thereby creating a path for the insulation air in chamber 144 to escape.

Although the seal body 31 and associated apparatus of FIGS. 1 and 2 provide increased thermal protection of disk post 20 relative to systems which expose outer surface 33 to hot gases ingested from flowpath 32 and to radiation heat transfer from the underside of platforms 28 of blades 22, the apparatus of FIGS. 1 and 2 is subject to the following limitations. The temperature of the air in forward cavity 134 which enters chamber 144 can be up to several hundred degrees hotter than the blade cooling air and substantially hotter than the allowable temperature of disk post 20. Therefore, caution has to be exercised to ensure that the velocity of the air passing across outer surface 33 is not too high. Unacceptably high velocities can cause the forced convection from the relatively hot forward cavity air passing across outer surface 33 to dominate the heat balance of disk post 20 which can actually result in the temperature of disk post 20 rising. Consequently, the system of FIGS. 1 and 2 is sensitive to manufacturing tolerances regarding the shape of diffuser hole 142. This sensitivity could be reduced by completely purging forward cavity 134 thereby lowering the temperature of the air in cavity 134. However, a high amount of cooling air would be required to accomplish this due to the relatively large gaps between angel wing 138 and lips 124 and 130, which would result in a costly engine performance penalty.

Figure 3:
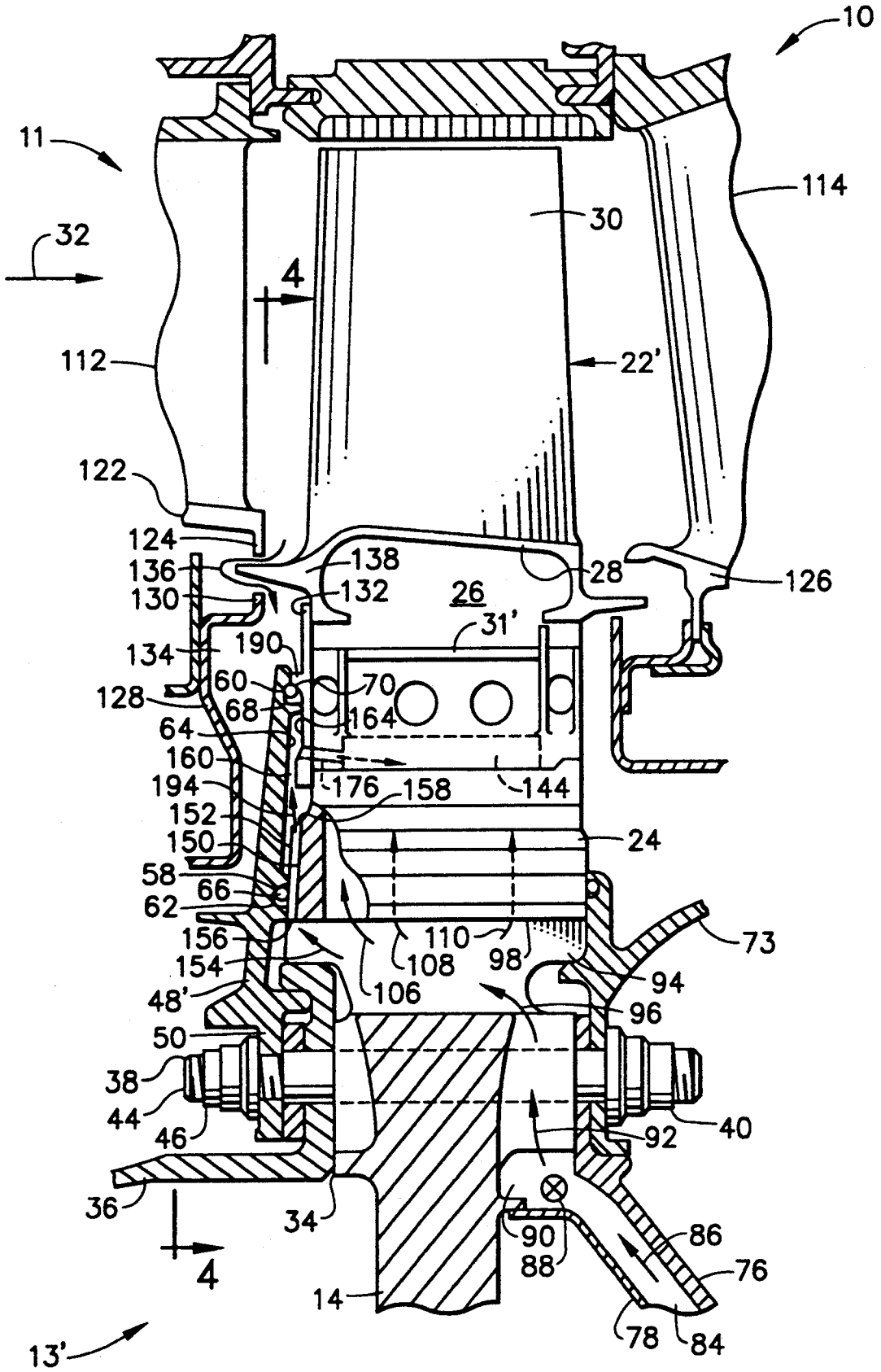
FIG. 3 is a cross-section similar to FIG. 1 illustrating the rotor assembly and disk post cooling system of the present invention.
Figure 4:
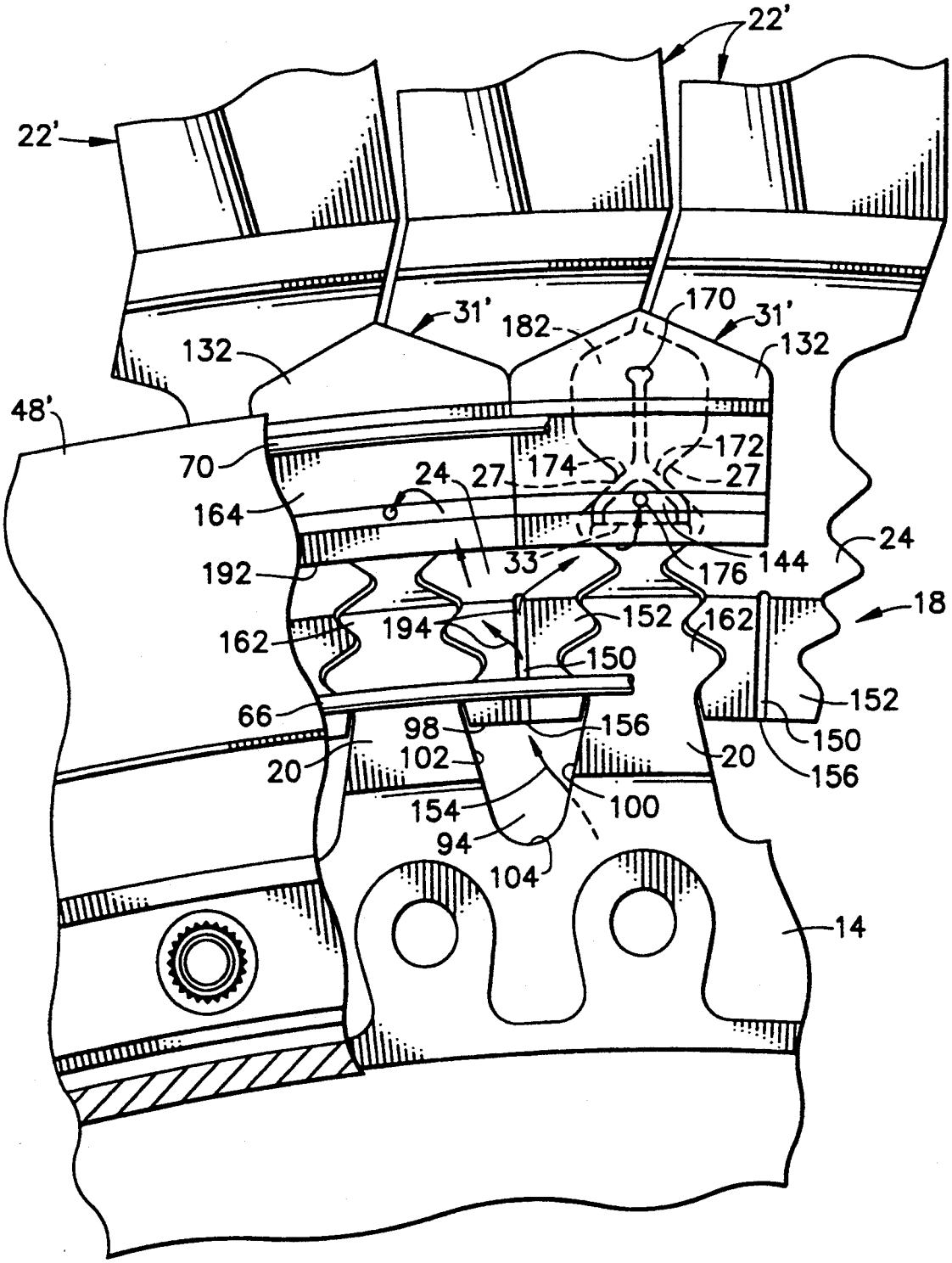
FIG. 4 is an axial view taken along line 4—4 of FIG. 3 with a portion of the blade retainer cut away.
Figure 5:
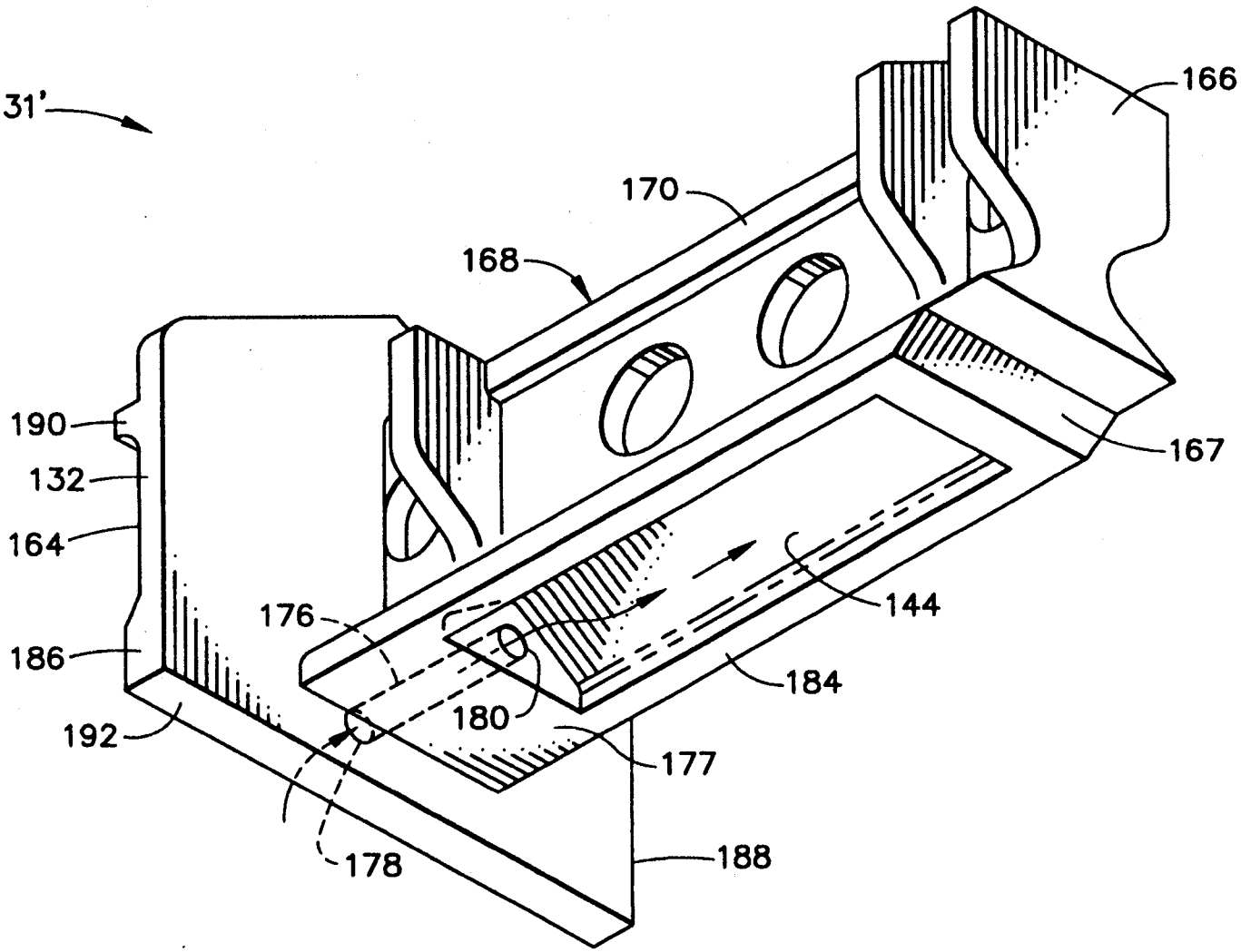
FIG. 5 is a perspective view illustrating the seal body of the present invention.

Referring now to FIGS. 3–5, the improved rotor assembly 13' of the present invention, and the included disk post cooling system of the present invention, are illustrated. As with prior art rotor assembly 13, assembly 13' includes an annular stage 1 turbine rotor disk 14 which is rotatable about axis 12 of engine 10 and which includes a plurality of axially extending and circumferentially alternating slots 16 and disk posts 20. Assembly 13' includes a plurality of radially extending blades 22' mounted on disk 14, wherein each slot 16 of disk 14 receives the dovetail portion 24 of one of the blades 22'. Blades 22' differ from blades 22 of assembly 13 as subsequently described. Assembly 13' further includes the following components which are interrelated and function as described previously with respect to prior art assembly 13: rotor shaft 36; shoulder bolts 38 and nuts 40; aft embossments 71; annular thermal shield 73; annular spacer impeller 76; and annular spacer impeller cover 78. Rotor assembly 13' of the present invention further includes an annular blade retainer 48' and a plurality of seal bodies 31' which differ from retainer 48 and seal bodies 31, respectively, of assembly 13 as subsequently discussed. The means for supplying high pressure compressor discharge cooling to plenums 94 also remains the same as described with respect to the apparatus of FIGS. 1 and 2 and therefore includes channel 84 formed between spacer impeller 76 and spacer impeller cover 78 and further includes plenum 90 and flowpaths 88, 92 and 96. Also, as with the apparatus of FIGS. 1 and 2, cooling air from plenums 94 enters internal cooling passages of blades 22' along paths 106, 108 and 110. However, unlike the apparatus of assembly 13, rotor assembly 13' prevents the relatively hot gases residing in forward cavity 134 from entering thermal isolation chambers 144. Instead, the disk post cooling system of rotor assembly 13' includes a means for diverting a portion of the relatively cool blade cooling air from plenums 94, which are positioned inward of the radially inner end 98 of blades 22', to the thermal isolation chambers 144 which are positioned over the radially outer surfaces 33 of disk posts 20. A portion of the cooling air is diverted from plenums 94 into a plurality of radially extending slots 150 which are formed in the axially forward surfaces 152 of the dovetail portions 24 of blades 22', as indicated by cooling flowpath arrow 154.

As best seen in FIGS. 3 and 4, one of the slots 150 is formed in the dovetail portion 24 of each of the blades 22' at a location approximately midway between the circumferentially facing sides of dovetail portion 24. Slots 150 are relatively shallow and do not communicate with the internal blade cooling passages and are located in a relatively low stressed area of blades 22'. Consequently, slots 150 do not adversely affect the structural integrity or useful service life of blades 22'. Each of the slots 150 has an entrance 156 which is adjacent to and in open flow communication with a respective one of the axially extending plenums 94, which extend through disk 14. Furthermore, slot entrances 156 are radially inward of inner sealing means 58 of blade retainer 48', which allows the air entering slots 150 along paths 154 to bypass inner sealing means 58. Each of the slots 150 has an exit 158 which is adjacent to and in open flow communication with an annular radially extending cooling air plenum 160 which is formed by inner and outer sealing means 58 and 60, the axially aft surface 64 of blade retainer 48', the axially forward surface 152 of each dovetail portion 24, an axially forward surface 162 of each of the disk posts 20, and an axially forward surface 164 of each of the seal body forward cover plates 132.

Referring to FIG. 5, which is a perspective view of seal body 31' of assembly 13', it can be seen that seal body 31' comprises forward cover plate 132, aft cover plate 166 and connecting member 168 which is integrally connected to forward and aft cover plates 132 and 166, respectively. In a preferred embodiment seal body 31' comprises a one-piece construction, such as a casting. As best seen in FIG. 4, connecting member 168 includes an axially extending beam section 170 and a pair of radially inward and opposed legs 172, 174 which are integrally connected to beam section 170, wherein legs 172 and 174 form thermal isolation chamber 144. Chamber 144 is bounded at forward and aft ends, respectively, by a radially inner and axially forward portion 177 of connecting member 168 and a radially inner portion 167 of aft cover plate 166. Seal body 31' further includes a passage means, comprising a hole 176, for directing air from the radially extending plenum 160 into thermal isolation chamber 144. Hole 176 extends through forward cover plate 132 and forward portion 177 of connecting member 168. Hole 176 has an entrance 178 adjacent to and in open flow communication with radially extending plenum 160 and an exit 180 adjacent to and in open flow communication with thermal isolation chamber 144. Although only one hole 176 is illustrated in each seal body 31', additional holes may be added to facilitate airflow into chamber 144. Each seal body 31' is positioned in cavity 182 which is bounded by radially outer surface 33 of one of the disk posts 20, the shank portions 26 and the platform portions 28 of circumferentially adjacent ones of blades 22'. Hole 176 is oriented with respect to engine longitudinal axis 12 such that cooling air flows from plenum 160 through hole 176 and impinges directly on radially outer surface 33 of disk post 20, thereby increasing the convection heat transfer coefficient relative to the diffuser hole 142 and the resultant convection heat transfer coefficient of the apparatus of prior art assembly 13. When gas turbine engine 10 is not operating, inner surface 184 of connecting member 168 is free to contact radially outer surface 33 of disk post 20. Cover plate 132 of each seal body includes circumferentially opposing and radially extending sides 186 and 188 and the plurality of seal bodies 31' are aligned circumferentially such that adjacent ones of sides 186 and 188 are in abutting relationship to prevent air leakage between the seal bodies. Furthermore, sides 186 and 188 extend radially outward of outer sealing means 60 thereby preventing cooling air leakage over the top, or radially outward surface, of forward cover plates 132. Relative to blade retainer 48 depicted in FIG. 1, the radial height of blade retainer 48' has been increased so that outer sealing means 60 is radially outward of entrances 178 of holes 176 and is in sealing engagement with outer lip 190 which is integrally connected with forward cover plate 132 and extends axially forward from an axially forward surface 164 of cover plate 132. Consequently, blade retainer 48' and outer sealing means 60 prevent forward cavity air from entering chamber 144. Cover plate 132 includes a radially inner edge 192 which is radially inward of radially outer surface 33 of disk post 20 as best seen in FIG. 4.

In operation, a portion of the high pressure compressor discharge cooling air which supplies the internal cooling passages of blades 22' is diverted from axially extending blade cooling plenums 94, wherein the diverted air enters the plurality of radially extending slots 150 formed in the dovetails portions 24 of each blade 22' as shown by flowpath arrow 154. The diverted cooling air exiting each of the slots 150 flows into annular radially extending plenum 160 as shown by arrows 194. Pressurized cooling air in plenum 160 is then directed through holes 176, which pass through forward cover plate 132 and connecting member axially forward portion 177 of seal body 31', thereby causing the cooling air to impinge directly upon the radially outer surface 33 of disk post 20. During operation of engine 10 centrifugal force causes outer surfaces of legs 172 and 174 of seal body connecting member 168 to contact the damper lobes 27 of shank portions 26 of adjacent blades 22' and creates a small radial clearance between connecting member inner surface 184 and radially outer surface 33 of disk post 20, thereby allowing the cooling air to escape from thermal isolation chamber 144.

Since the disk post cooling system of the present invention utilizes relatively cool blade cooling air, as opposed to relatively hot forward cavity air, the system is not sensitive to the geometry of holes 176. Furthermore, due to the orientation of holes 176, the relatively high convection heat transfer coefficient associated with impingement cooling may be advantageously utilized thereby minimizing the amount of cooling air required and the associated performance penalty. Also, the position of slots 150 on dovetail portions 24 of blades 22' and the relatively shallow depth of slots 150 allow the blade cooling air to be diverted without adversely affecting the structural integrity of blades 22'. In conclusion, the disk post cooling system of the present invention cools the radially outer surfaces 33 of disk posts 20 in a cost effective manner without compromising the structural integrity of rotor blades 22' and without a manufacturing tolerance sensitivity regarding the geometry of seal body holes 176.

While the foregoing description has set forth the preferred embodiments of the invention in particular detail, it must be understood that numerous modifications, substitutions and changes can be undertaken without departing from the true spirit and scope of the present invention as defined by the ensuing claims. For instance, although the disk post cooling system illustrated in FIGS. 3–5 diverts blade cooling air from axially extending blade cooling plenums 94 to thermal isolation chambers 144 via a flowpath extending along the forward sides of blades 22' and disk posts 20, the advantages of the present invention may be realized by diverting blade cooling air to thermal isolation chambers 144 via a flowpath extending along the aft sides of blades 22' and disk posts 20. This may be accomplished by: employing blade retainer 48 as shown in FIG. 1 which has a reduced radial height as compared to retainer 48'; forming slots 150 in an aft surface of the dovetail portion 24 of each blade 22'; rotating seal body 31' 180° so that plate 132 becomes an aft cover plate and outer lip 190 extends axially aft; increasing the radial height of forward flange 74 of thermal shield 73 so that it extends radially outward of holes 176; and forming plenum 160 axially between aft surfaces of dovetail portions 24, disk posts 20 and seal bodies 31' and a forward surface of flange 74, and radially between outer sealing means 60, in sealing engagement with lip 190 and flange 74, and inner sealing means 58 in sealing engagement with dovetail portions 24, disk posts 20 and flange 74. The protection desired to be secured by Letters Patent of the U.S. for this invention is defined by the subject matter of the following claims.

What is claimed is:

1. In a rotor assembly for a gas turbine engine having a turbine rotor disk and a plurality of radially extending blades mounted on the disk, the disk including a plurality of circumferentially alternating posts and slots disposed about a periphery of the disk, each of the slots receiving a dovetail portion of one of the blades, each blade having a shank portion extending radially outward from the dovetail portion and a platform portion atop the shank portion, a system for cooling each of the disk posts, said system comprising:

a) a plurality of seal bodies, wherein each of said seal bodies includes a thermal isolation chamber positioned over a radially outer surface of one of the disk posts;

b) means for supplying cooling air to a plurality of axially extending blade cooling plenums positioned radially inward of the blades, said plenums extending through the disk;

c) means for diverting cooling air from said axially extending blade cooling plenums to said thermal isolation chambers, wherein said means for diverting comprises a radially extending slot formed in an axially facing surface of each of the blade dovetail portions.

2. A cooling system as recited in claim 1, wherein:

a) each of said seal bodies is positioned in a cavity bounded by said radially outer surface of the one of the disk posts, the shank portions of adjacent blades and the platform portions of the adjacent blades;

b) each of said seal bodies includes an axially forward cover plate, an axially aft cover plate and a connecting member integrally said connected to each of said forward and aft plates; and c) said connecting member includes a pair of radially inward and opposed legs which form said thermal isolation chamber.

3. A cooling system as recited in claim 1, wherein:

a) each of said radially extending slots has an entrance adjacent with and in open flow communication with one of said axially extending plenums, and an exit adjacent with an in open flow communication with an annular radially extending cooling air plenum formed in part by said axially facing surface of each of the blade dovetail portions; and b) said means for diverting further comprises passage means formed in each of said seal bodies for directing cooling air from said annular radially extending plenum into said thermal isolation chambers.

4. In a rotor assembly for a gas turbine engine having a turbine rotor disk and a plurality of radially extending blades mounted on the disk, the disk including a plurality of circumferentially alternating posts and slots disposed about a periphery of the disk, each of the slots receiving a dovetail portion of one of the blades, each blade having a shank portion extending radially outward from the dovetail portion and a platform portion atop the shank portion, a system for cooling each of the disk posts, said system comprising:

a) a plurality of seal bodies, wherein each of said seal bodies includes a thermal isolation chamber positioned over a radially outer surface of one of the disk posts, wherein:

i) each of said seal bodies is positioned in a cavity bounded by said radially outer surface of one of the disk posts, the shank portions of adjacent blades and the platform portions of the adjacent blades;

ii) each of said seal bodies includes an axially forward cover plate, an axially aft cover plate and a connecting member integrally connected to each of said forward and aft plates; and iii) said connecting member includes a pair of radially inward and opposed legs which form said thermal isolation chamber;

b) means for supplying cooling air to a plurality of axially extending blade cooling plenums positioned radially inward of the blades, said plenums extending through the disk;

c) means for diverting cooling air from said axially extending blade cooling plenums to said thermal isolation chambers; and d) an annular blade retainer having a radially inner end fixedly attached to the disk, said annular blade retainer including:

i) an annular inner sealing means in sealing engagement with an axially forward surface of each of the blade dovetail portions and an axially forward surface of each of the disk posts, and ii) an annular outer sealing means in sealing engagement with an axially forward surface of each of said axially forward cover plates of said seal bodies;

e) wherein said means for diverting comprises:

i) a radially extending slot formed in said axially forward surface of each of the blade dovetail portions, each of said slots having an entrance adjacent one of said axially extending plenums thereby establishing open flow communication with said plenum, each of said slots further including an exit adjacent with and in open flow communication with an annular radially extending cooling air plenum formed by said annular inner and outer sealing means, said axially forward surfaces of each of the blade dovetail portions, disk posts, and axially forward cover plates of said seal bodies and an axially aft surface of said annular blade retainer; and ii) passage means formed in each of said seal bodies for directing cooling air from said annular radially extending plenum into said thermal isolation chambers.

5. A cooling system as recited in claim 4, wherein said passage means comprises at least one hole extending through said axially forward cover plate of each of said seal bodies, each of said holes having an entrance adjacent to said annular radially extending plenum and an exit adjacent to one of said thermal isolation chambers, each of said holes being oriented such that the cooling air impinges directly on said radially outer surface of a corresponding one of the disk posts.

6. A cooling system as recited in claim 5, wherein said annular inner sealing means is radially outward of said entrances of said slots and radially inward of said exits of said slots.

7. A cooling system as recited in claim 5, wherein said annular outer sealing means is radially outward of said entrances of said holes.

8. A cooling system as recited in claim 7, wherein each of said annular inner and outer sealing means comprises an annular groove formed in said axially aft surface of said annular blade retainer and an annular seal wire disposed in a corresponding one of said annular grooves.

9. A cooling system as recited in claim 7, wherein said seal bodies are aligned circumferentially such that said axially forward cover plates of said seal bodies are in abutting relationship with one another, wherein abutting sides of each of said axially forward cover plates extend radially outward of said annular outer sealing means.

10. A cooling system as recited in claim 4, wherein each of said axially extending blade cooling plenums is defined by a radially inner surface of the dovetail portion of one of the blades, circumferentially opposing sides of adjacent disk posts and a contoured disk slot bottom interconnecting the opposing sides.

* * * * *